US007669728B2

(12) United States Patent
Licata

(10) Patent No.: US 7,669,728 B2
(45) Date of Patent: Mar. 2, 2010

(54) SPEEDY BAG—BAG DISPENSING SYSTEM

(76) Inventor: Jack Joseph Licata, 24 Washington Ave., Bernardsville, NJ (US) 07924

( * ) Notice: Subject to any disclaimer, the term of this patent is extended or adjusted under 35 U.S.C. 154(b) by 779 days.

(21) Appl. No.: 11/140,178

(22) Filed: May 31, 2005

(65) Prior Publication Data

US 2006/0226153 A1 Oct. 12, 2006

(51) Int. Cl.
*B65D 90/00* (2006.01)
*B65D 25/14* (2006.01)
*B65D 6/00* (2006.01)

(52) U.S. Cl. ..... 220/495.01; 220/495.07; 220/4.07; 220/908

(58) Field of Classification Search ..... 220/908, 220/495.07, 407; 206/554, 395–399, 401, 206/53, 54; 383/37, 207, 66; 222/165, 167, 222/168, 172

See application file for complete search history.

(56) References Cited

U.S. PATENT DOCUMENTS 5,353,950 A * 10/1994 Taylor et al. ..... 220/495.07
5,564,762 A * 10/1996 Ring ..... 294/1.3
5,632,401 A * 5/1997 Hurd ..... 220/495.07
2006/0138149 A1* 6/2006 Tracy ..... 220/495.07

* cited by examiner

*Primary Examiner*—Anthony Stashick
*Assistant Examiner*—Shawn M Braden
(74) *Attorney, Agent, or Firm*—Harold G. Furlow, Esq.

(57) ABSTRACT

A container holds plastic bags which are sequentially linked together and deployed one at a time. When the last bag is deployed, the container which the bags are stored follows the last bag out of the receptacle. The container can then be disposed of, recycled, or refilled.

8 Claims, 4 Drawing Sheets

FIG 5
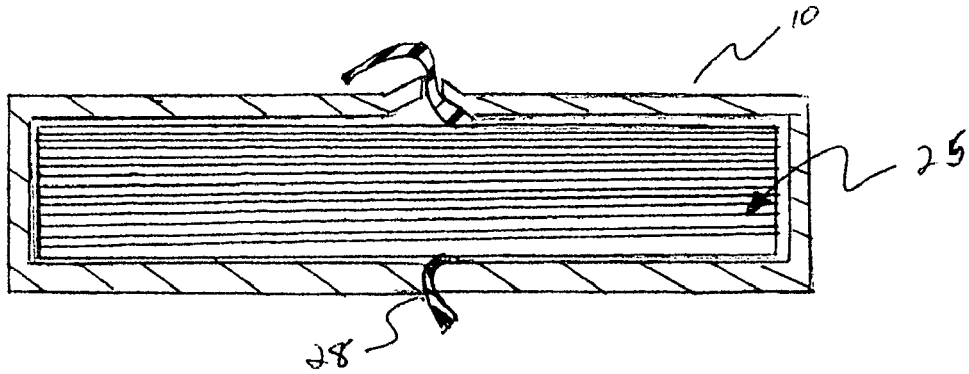
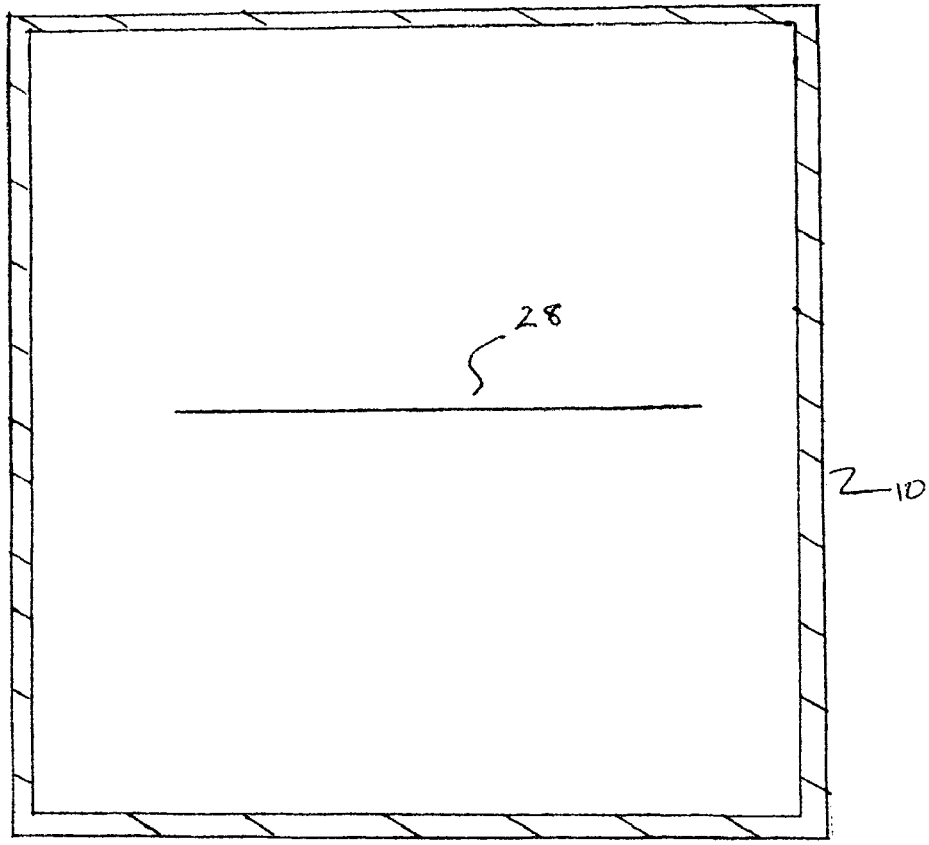
FIG 6

SPEEDY BAG—BAG DISPENSING SYSTEM

BACKGROUND OF THE INVENTION

Trash bags are mainly used to line a receptacle. The problem is the liners are never near the receptacle and someone has to retrieve a liner from a remote location to complete the function, too much time and too many man hours are wasted in this process.

Many people in a residential or commercial application will store several extra bags in the bottom of the trash can receptacle as a means to speed up the entire cycle of changing trash can liners.

In an industrial cleaning, health care, or fast food application the time and cost factor for this process is significant.

Many times this job has been delegated to people with handicaps or mental illness. A more efficient, easier, cleaner, and less cumbersome way of having these bags readily available has been needed for some time.

SUMMARY OF THE INVENTION

The invention is a system which is convenient and economical for packaging, deploying, and distributing plastic bags, primarily, but not exclusively in the waste arena. The invention puts bags at the source of where they are being used. For example in the waste industry the Speedy Bag System will be in the bottom of the receptacle, when the full bag is removed the next one to replace it is automatically discharged and ready to line the receptacle. Thus speeding up the process of relining the receptacle, rather than creating a need to find a replacement bag that may be in a remote location like a back store room or cleaning cart.

Because the bags are connected at a point of weakness and packed sequentially, the next bag to be used follows the full bag being removed. After all but the last bag are used up, the last bag is attached to the container through a score in the underside of the container causing the said container to follow the last bag out of the receptacle as the last bag is removed. The container can be disposed of, recycled, or refilled.

Then a new Speedy Bag System is put into the bottom of the receptacle so that a large number of bags in a protected container will remain at the bottom of the trash receptacle for the process to be repeated.

Other details and advantages of the invention will become apparent with the following description of the embodiment and accompanying drawings.

Description of the drawings

FIG. 5. shows a side section of the container with the first bag protruding through the top opening and the last bag protruding through the score on the underside.

FIG. 6. shows the underside of the container with score line.

DESCRIPTION OF ILLUSTRATED EMBODIMENT

Figure 1:
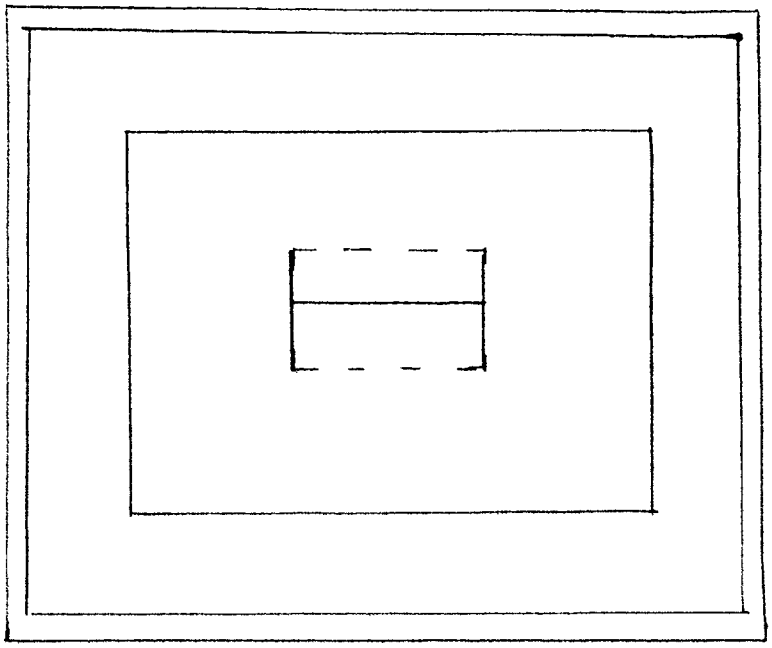
FIG. 1. shows a top view looking down into a trash can at an unopened container of trash bags lying at the bottom of the trash can.

Referring now more particularly to the drawings, there is shown a plan view FIG. 1. of a container holding the bags 10, resting in the bottom of a trash can 12. The container 10, has on its top an opening 16, with two hinged doorways 18, causing the doors to fold outward from the center opening 16.

Figure 2:
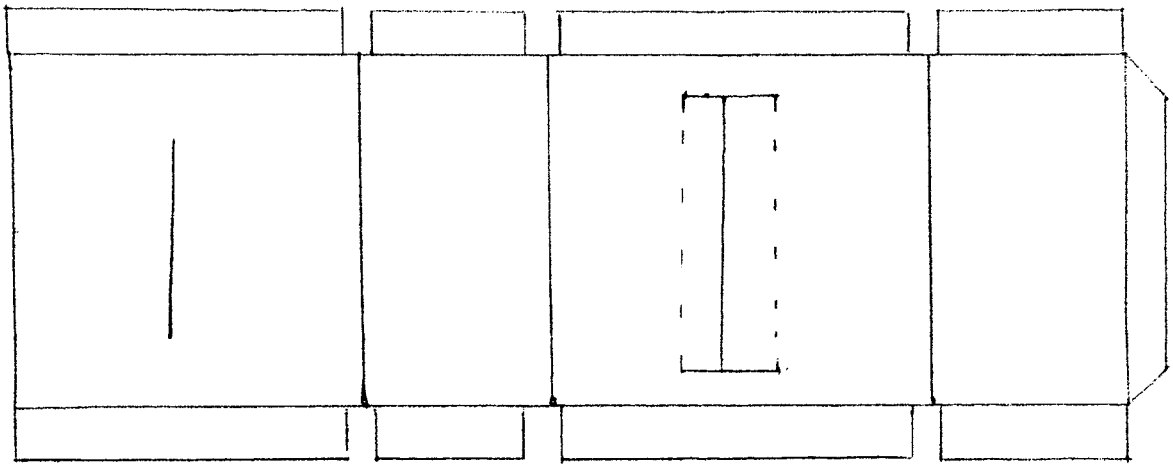
FIG. 2. is a view, in reduced scale, of a blank to form container laid out flat before it is erected.

FIG. 2. is a view of the container blank laid out flat. It has the hinged doors 18, and the cuts in the top 17, and two perforated sides 19, acting as hinges for the opening. The score 28, is what has the last bag attach to the container 10.

Figure 3:
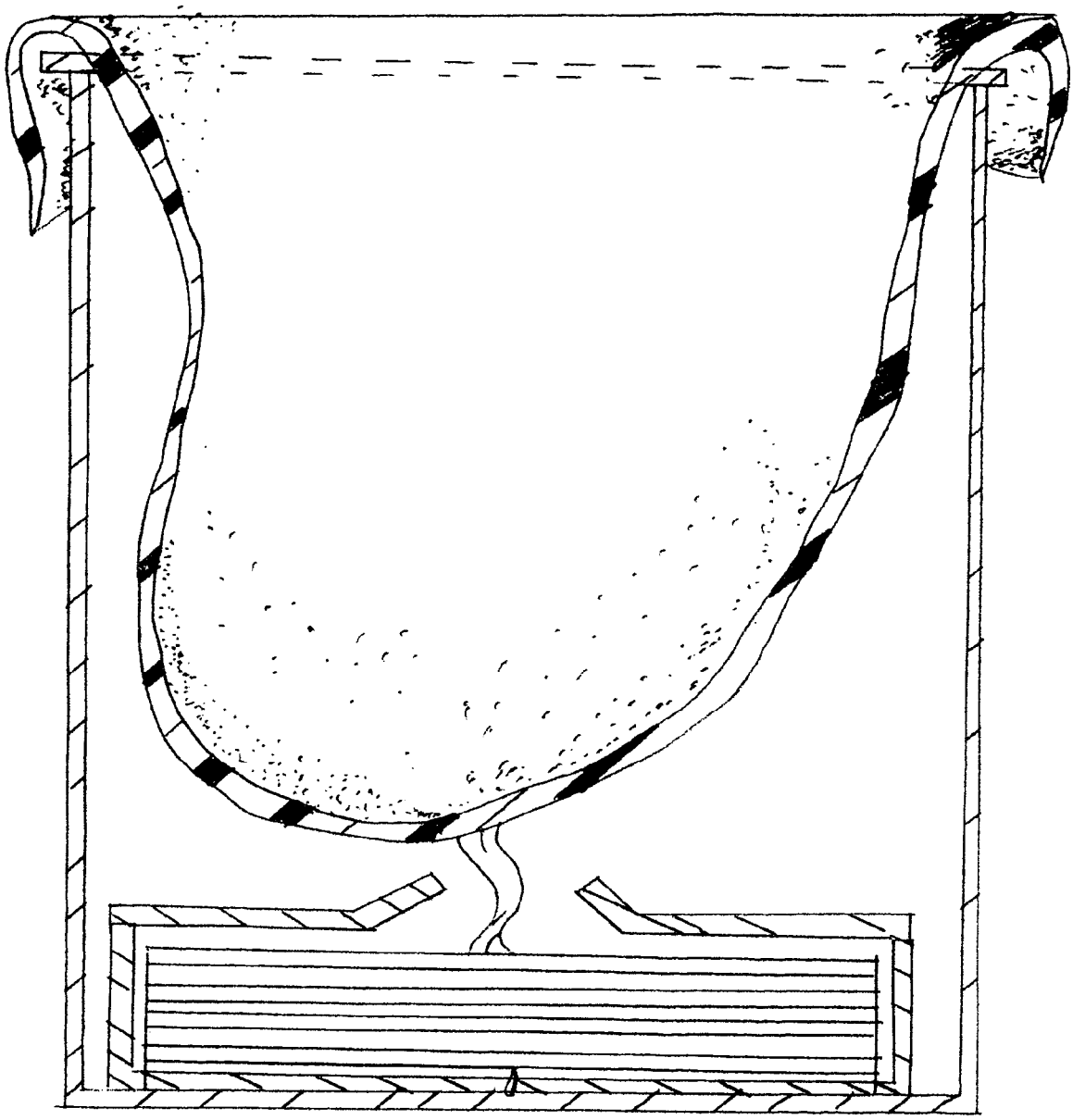
FIG. 3. shows a section corresponding to FIG. 1 of what it looks like after the container has been opened and a bag has been deployed from the container.

FIG. 3. encompasses the entire system in action where we see a deployed bag 20, dispensed from container 10, secured around the top lid of the trash can 22. The next sequential bag 24, is attached at the bottom of the deployed bag 20 by tear lines in the form of perforations 25, extending transversely between them. The remaining bags in the box 26 are similarly attached to each other. The last bag 27, is fed approximately ½'" through the score line in the underside of the container which then secures the bags to the container 10.

Figure 4:
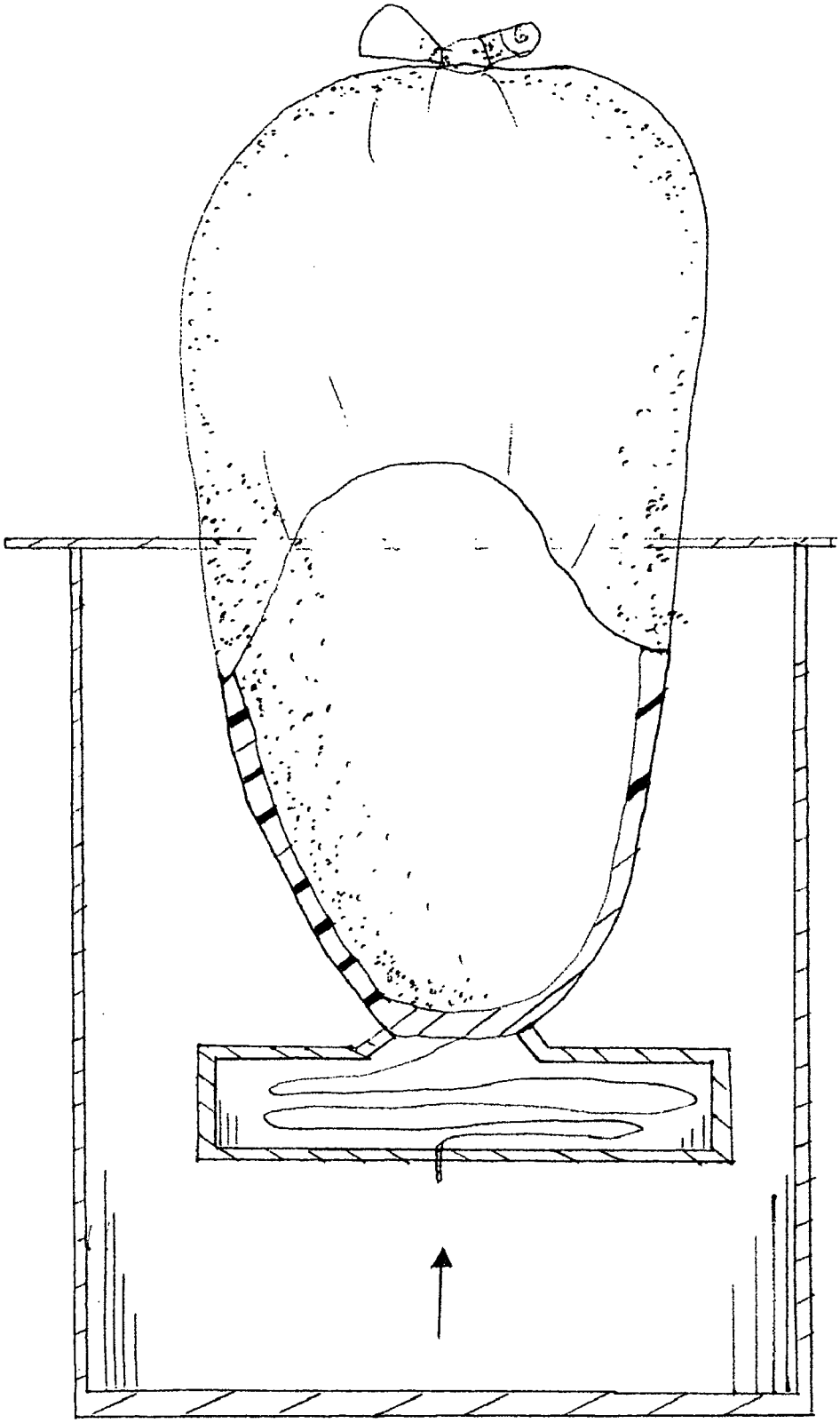
FIG. 4. shows a sectional view corresponding to FIG. 1 but showing the last bag attached to the bottom panel and protruding through the score in the container and pulling up the container in the receptacle.

FIG. 4. is a more precise view of the end of the system after all but the last bag have been used and this last bag 27, is full of trash, tied at the top 30, and being removed from the trash can 12. The score 28, holds the last bag 27, the container 10, causing the container to be pulled up with the last bag out of the trash can 12.

FIG. 5. is a section view of the full container 10, with the nested bags 26, and the score line 28, with the last bag 27, protruding from the lower flap.

FIG. 6. is a plan view of a container 10, bottom view showing the score line 28.

What is claimed is:

1. A system for dispensing bags from a receptacle comprising a container adapted to be situated in the receptacle containing a plurality of sequentially connected bags including a last bag, said container having an opening through which the bags may be sequentially removed from said container and a surface having a slit, adjacent bags being separatable as they are removed from said container, wherein at least a portion of said last bag extends through said slit in said surface of said container so as to prevent said last bag from separating from said container until said last bag and said container are removed together from the receptacle the slit is a score in an underside of the container and the last bag is attached to the container through the score in the underside of the container that causes the container to follow the last bag out of the receptacle as the last bag is removed.

2. The system of claim 1 wherein said surface of said container comprises the bottom surface.

3. The system of claim 1 wherein the container is a box.

4. The system of claim 1 wherein said adjacent ones of said bags are detachably connected.

5. The system of claim 1 wherein said last bag and said container may be separated after said last bag and said container are removed together from the receptacle.

6. The system of claim 5 wherein said container may be refilled, recycled or discarded after said last bag is separated therefrom.

7. A system for dispensing bags comprising a container adapted to be put into the bottom of a receptacle, the container containing a plurality of sequentially connected bags including a last bag, the container defines an opening in the top through which the plurality of bags may be sequentially removed from the container, the container includes an underside that defines a score, the score receives a portion of the last bag and secures the last bag to the container and prevents the separating of the last bag of the plurality of bags from the container until the last is deployed, the last bag and the container removable together from the receptacle and the last and container separable, the container constructed for being refilled.

8. The system of claim 7, wherein the container is recyclable.

* * * * *